US008390463B2

(12) United States Patent
Munthe-Kaas et al.

(10) Patent No.: US 8,390,463 B2
(45) Date of Patent: Mar. 5, 2013

(54) EMERGENCY SIGNAL BRACELET

(75) Inventors: Karl Alveng Munthe-Kaas, Oslo (NO); Morten Efraimsen Andersen, Oslo (NO)

(73) Assignee: Evacuaid AS, Oslo (NO)

( * ) Notice: Subject to any disclaimer, the term of this patent is extended or adjusted under 35 U.S.C. 154(b) by 385 days.

(21) Appl. No.: 12/739,145

(22) PCT Filed: Oct. 24, 2008

(86) PCT No.: PCT/NO2008/000376

§ 371 (c)(1),
(2), (4) Date: Aug. 17, 2010

(87) PCT Pub. No.: WO2009/054730

PCT Pub. Date: Apr. 30, 2009

(65) Prior Publication Data

US 2010/0309000 A1 Dec. 9, 2010

(30) Foreign Application Priority Data

Oct. 26, 2007 (NO) ..... 20075437

(51) Int. Cl.
*G08B 23/00* (2006.01)

(52) U.S. Cl. ..... 340/573.1; 600/301; 600/595; 340/539.12; 340/565; 340/686.1; 340/539.13

(58) Field of Classification Search ..... 340/224, 340/111, 277, 539.15, 573.4; 702/131; 374/109, 374/349, 549; 128/202.23; 131/329, 231; 335/205, 206

See application file for complete search history.

(56) References Cited

U.S. PATENT DOCUMENTS

| | | | | |
|---|---|---|---|---|
| 3,594,748 | A * | 7/1971 | Grotjahn | 340/539.11 |
| 3,673,526 | A * | 6/1972 | Brevick | 335/205 |
| 4,418,337 | A | 11/1983 | Bader | |
| 4,524,243 | A * | 6/1985 | Shapiro | 379/38 |
| 4,602,646 | A * | 7/1986 | Cascalenda et al. | 131/329 |
| 4,829,285 | A * | 5/1989 | Brand et al. | 340/573.1 |
| 5,541,579 | A * | 7/1996 | Kiernan | 340/573.1 |
| 5,612,675 | A | 3/1997 | Jennings et al. | |
| 5,633,623 | A * | 5/1997 | Campman | 340/321 |
| 5,689,240 | A * | 11/1997 | Traxler | 340/573.4 |
| 5,936,530 | A * | 8/1999 | Meinhold | 340/573.1 |
| 5,949,337 | A * | 9/1999 | Campman | 340/573.1 |
| 6,016,099 | A | 1/2000 | Campman | |
| 6,072,392 | A * | 6/2000 | Henderson et al. | 340/539.15 |
| 6,847,913 | B2 * | 1/2005 | Wigley et al. | 702/131 |
| 2007/0106124 | A1 | 5/2007 | Kuriyama et al. | |
| 2007/0197887 | A1 * | 8/2007 | Lunak et al. | 600/323 |

FOREIGN PATENT DOCUMENTS

| | | |
|---|---|---|
| GB | 2323196 | 9/1998 |

* cited by examiner

*Primary Examiner* — Benjamin C Lee
*Assistant Examiner* — Chico A Foxx
(74) *Attorney, Agent, or Firm* — Christian D. Abel

(57) ABSTRACT

A bracelet (100) for use during escape in the event of fire, comprising a housing (110) attached to a strap (120) where the housing (110) is pressed against the wrist when the strap (120) is tightened, and where the housing (110) comprises control electronics for warning by sound- and light units, and where the bracelet (100) comprises a device in the housing (110) which is connected to control electronics in order to detect whether the bracelet (100) is in motion or not, and means for controlling transmission of sound and light on the basis of said detection, and an attachment mechanism for the strap (120) to the housing (110) comprising means for activating the bracelet (100) when the strap (120) is tightened round the wrist.

9 Claims, 2 Drawing Sheets

EMERGENCY SIGNAL BRACELET

INTRODUCTION

The present invention relates to a device for use by a person during escape in the event of fire. More specifically, the invention relates to a bracelet with warning means, together with an attachment mechanism with means for activating various functions in the bracelet when it is drawn tight round a wrist.

THE PRIOR ART

Escaping from fire is a critical situation which can lead to stress and fear. In such a situation it is vital that the equipment to be employed by those who are escaping is robust and very easy to use.

U.S. Pat. No. 4,418,337 is considered to represent the closest prior art in the field. In this publication, an alarm device is described for monitoring the movements of a person, e.g. a fireman who has the device attached to his clothing. The alarm device comprises a motion sensor, signal-processing circuit and an alarm, all of the parts being contained in a housing. The motion sensor comprises a permanent magnet attached to one end of a spring located inside an induction coil which is wound round a roller. The other end of the spring is attached to the printed circuit board, thereby inducing a voltage across the coil due to vibrations of the magnet relative to the coil in response to the movements of the alarm device. The signal-processing circuit activates the alarm, which then generates a signal if the person does not move, for example as the result of an injury, within a predetermined period of time.

There are, furthermore, various electronic alarm devices which are intended for use in a bracelet. The main focus of these is to provide different alarm functions for the user wearing the bracelet. These are usually different types of burglar alarms and emergency alarms. The simplest embodiments involve a sound alarm which goes off when the user chooses to start it. In more sophisticated embodiments there is a radio transmitter in a bracelet which transmits emergency signals which can be picked up and interpreted by external equipment.

It has been found, however, that there is a need for a new type of alarm which can be used during evacuation or escape in the event of fire, and which is easy to use.

The present invention attempts to provide such a device by providing a bracelet for use during escape in the event of fire. The device has features which make it easy to use in an emergency situation. The only thing the user needs to do is to put on the bracelet and tighten it round the wrist in a simple movement. This action will activate the control electronics in the bracelet, thus making its functions operative. The functions are sound and light signals which are controlled according to the status of the bracelet.

An important characteristic of the invention is the automatic activation of the bracelet when it is put on. Light will then be activated immediately to facilitate orientation in smoke and darkness.

A strobe light and sound signal are activated automatically by means of a motion sensor if the user has not moved for a while, for example if he (she) is unconscious. The invention helps to make an accident victim easier to find, and gives the user increased security without impairing the power of movement.

The bracelet is only activated when attached to a person, and therefore does not attract unnecessary attention.

Thus the present invention combines important functions without demanding more of a person who is already in a chaotic environment than that he (she) puts on the bracelet.

SUMMARY OF THE INVENTION

As already mentioned, the object of the present invention is to provide a device which is employed during evacuation or escape in the event of fire, and which is easy to use. This is provided according to the present invention by a bracelet which has to be used during the escape.

More specifically, the invention is characterised by a bracelet for use on a wrist during escape in the event of fire, comprising a housing attached to a strap comprising a first and second part which can be moved relative to each other, thereby enabling the circumference of the strap to be adjusted, and where the housing is pressed against the wrist when the strap is tightened, and where the housing comprises a power supply and control electronics for controlling a sound and light signal warning, and where the bracelet further comprises a device in the housing connected to the control electronics for detecting a status as to whether the bracelet is in motion or not, and means for controlling transmission of sound and light on the basis of the detected status, and an attachment mechanism for the strap to the housing comprising means for activating the control electronics in the bracelet when the strap is tightened round the wrist, as well as for deactivating the control electronics in the bracelet when the strap is slackened off again.

The said attachment mechanism for the strap comprises a first and second attachment mechanism on opposite sides of the housing, where one end of the strap is fastened in the said first attachment mechanism by means of a fastening device, and where the other end of the strap is attached to a holding device which is attached to an upper end of a spring mechanism located in a pocket in the housing, where the lower end of the spring mechanism is fastened to the housing, while the upper end can move freely in a linear movement in the pocket, and where the spring mechanism is compressed when the strap is tightened round the wrist, with the result that contact is established in a switch located in the housing, and where the switch is connected to the said control electronics, thereby causing the bracelet to be activated.

The novel and characteristic features of the bracelet which is the subject of the invention will become apparent in the independent claim 1 in the attached set of claims.

Further characteristic features of the bracelet are further described in related dependent claims.

DETAILED DESCRIPTION

The invention will now be described in greater detail with reference to FIGS. 1 to 3 which illustrate embodiments of the bracelet, in which:

FIG. 1 illustrates the bracelet 100 tightened round a wrist. The bracelet 100 is particularly well suited for use during escape in the event of fire, but other areas of application may be relevant, for example for inspection of various structures where this is conducted in dangerous environments.

The bracelet 100 comprises a housing 110 which is attached to a strap 120 comprising a first and second part which can be moved relative to each other, thereby enabling the circumference of the strap 120 to be adjusted. The housing 110 is pressed against the wrist when the strap 120 is tightened. The housing 110 comprises a power supply and control electronics for controlling a sound and light signal warning.

In the bracelet housing 110 there is a device which is connected to the control electronics for detecting a status as to whether the bracelet 100 is in motion or not, and means for controlling transmission of sound and light on the basis of the detected status, together with an attachment mechanism for the strap 120 to the housing 110 comprising means for activating the control electronics in the bracelet 100 when the strap 120 is tightened round the wrist, as well as means for deactivating the control electronics in the bracelet 100 when the strap 120 is slackened off again. This will be described in greater detail below with reference to FIG. 3. The means for detecting motion is preferably a motion detector which together with the said control electronics determines whether or not the bracelet should transmit light and sound.

Figure 1:
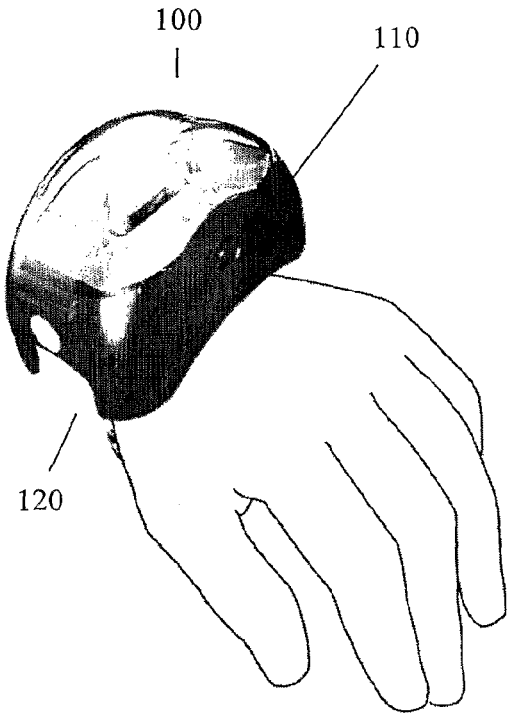
FIG. 1 illustrates a bracelet tightened round a wrist.
Figure 2:
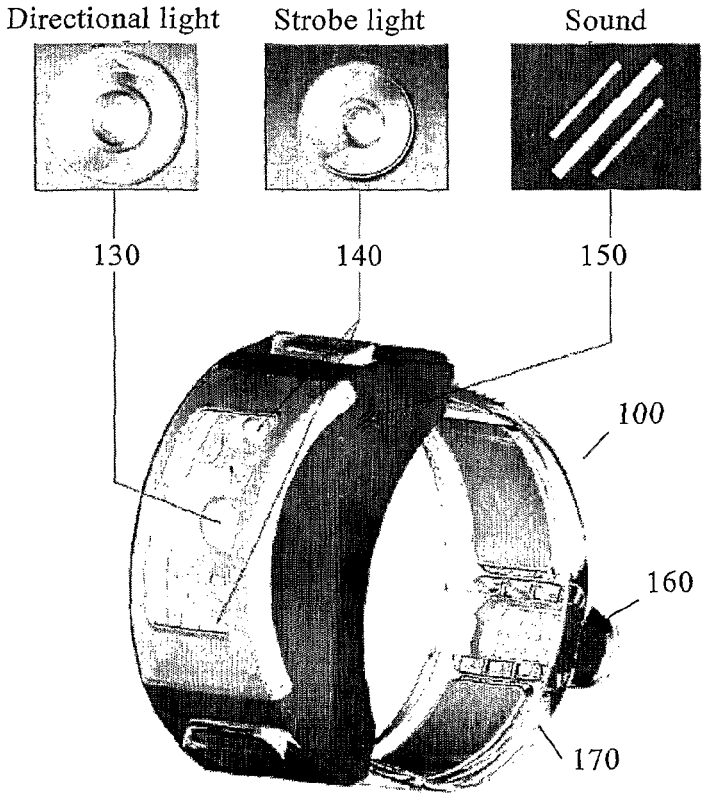
FIG. 2 illustrates details of incorporated warning devices.

FIG. 2 illustrates details of incorporated light and warning devices in order to see and be seen and heard. These preferably involve a directional light 130, a strobe light 140 and a sound-generating device 150, where the directional light 130 is employed as a torch for lighting up the environment, and lights up when the bracelet is activated. The strobe light 140 will issue a warning to the environment by blinking, while the sound-generating device 150 will transmit a powerful sound signal. The two last-mentioned are started up when the bracelet 100 is activated, i.e. tightened round a wrist, and has not been in motion for a predetermined period.

The said light devices are located in the housing 110 and in different embodiments may comprise one or more light sources. Directional light 130 is preferably one or more high-power LED lamps, while the strobe light 140 is a discharge tube. The invention, however, is not limited to which and how many light devices are located in the housing 110. Even though the light devices illustrated in FIG. 2 cast light upwards, in an embodiment they may also cast light forwards or only forwards.

In an embodiment the bracelet comprises a filter 160 which is attached to the strap 120. This may either be attached directly to the strap as illustrated in FIG. 2, or it may be connected to the strap in another way, such as by being suspended from a string which in turn is attached to the strap. The filter 160 may be a dust and/or charcoal filter suitable for filtering out dust and carbon soot which are a problem when fire breaks out.

The bracelet 100 may furthermore have a reflector 170 on its outside. The reflector may be on the outside of the strap 120 and/or on the outside of the housing 110.

In an embodiment the bracelet 100 is covered with friction material on its inside to facilitate tightening of the strap 120 round the wrist with only one movement. The friction material is preferably attached under the housing 110 and on the part which is in contact with the wrist. This will prevent the bracelet 100 from turning round the wrist when the strap 120 is tightened, so that only one operation is necessary.

Figure 3:
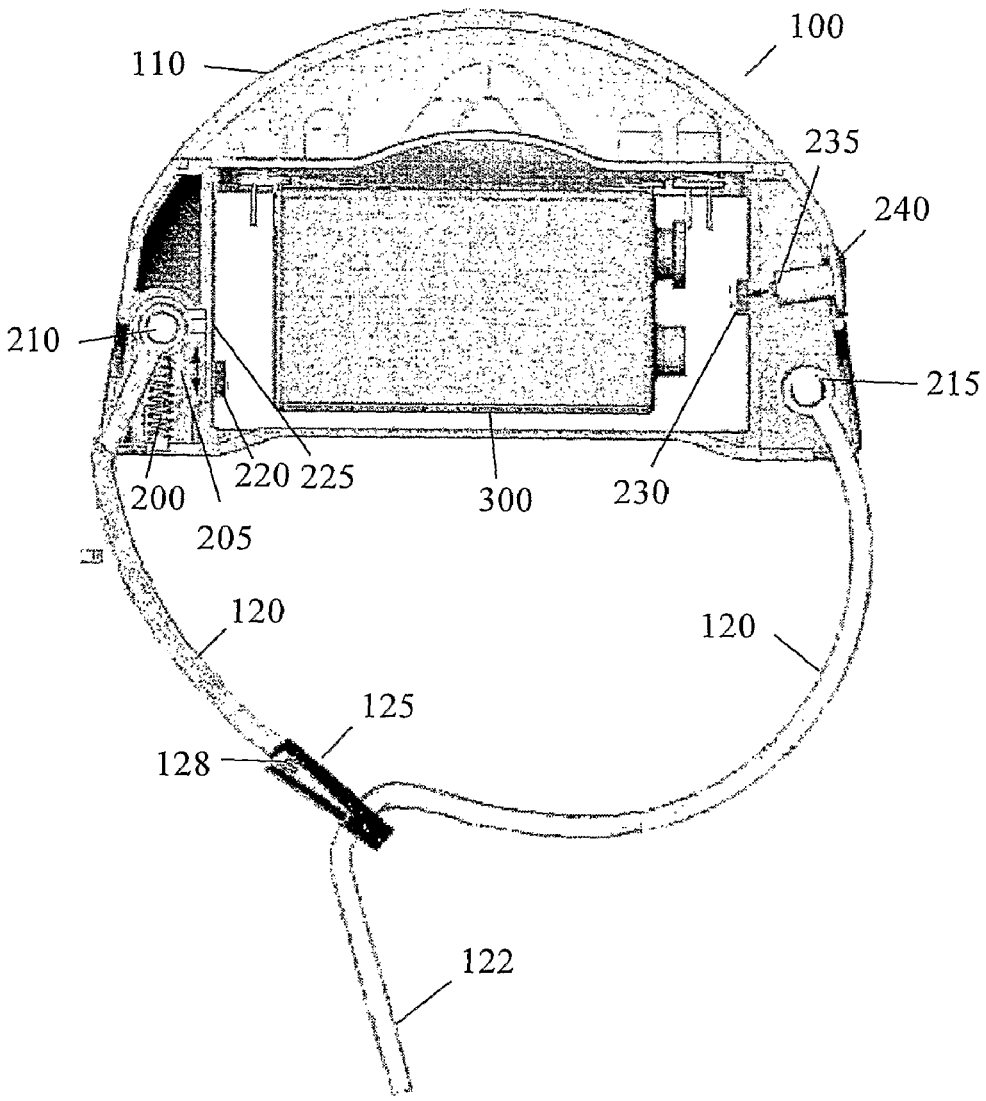
FIG. 3 illustrates the attachment mechanism and the means for activating the control electronics in the bracelet.

FIG. 3 illustrates the attachment mechanism and the means for activating the control electronics in the bracelet 100. An example is shown where the attachment mechanism for the strap 120 comprises a first and second attachment mechanism on opposite sides of the housing 110, where one end of the strap 120 is fastened to the said first attachment mechanism by means of a fastening device 215, and where the other end of the strap 120 is attached to a holding device 210 which is attached to an upper end of a spring mechanism 200 located in a pocket 205 in the housing 110. The lower end of the spring mechanism 200 is fastened to the housing 110, while the upper end can move freely in a linear movement in the pocket 205, and where the spring mechanism 200 is compressed when the strap 120 is tightened round the wrist, with the result that contact is established in a switch 220 located in the housing 110, and where the switch 220 is connected to the said control electronics, with the result that the bracelet 100 is activated.

In an embodiment the holding device 210 comprises a magnet 225 which has the effect of establishing contact in said switch 220 when the spring mechanism 200 is compressed and the magnet comes close to the switch 220. In this case the switch is a "Reed switch".

When the bracelet 100 is activated it is in stand-by mode, i.e. it is the said motion detector which determines the mode of operation of the bracelet 100. If the bracelet 100 is activated and in motion, the directional light 130 will preferably light up to show the way to a person moving with the bracelet 100 on his (her) arm. When the bracelet has remained at rest for a certain time, it will transfer to another mode, which in an embodiment may warn the user by means of sound that a full warning with light and sound will be implemented forthwith. If the bracelet is then not moved within a certain time, for example 4 seconds, full warning will be implemented. The strobe light 140 will then blink and a loud noise will be transmitted from the sound-generating device 150. This may be a piezo-electric element. It is also possible to go directly to a full warning by pressing the automatic release button 240 when the bracelet 100 is activated.

As already mentioned, the strap 120 comprises two parts which can be moved relative to each other, thereby enabling the housing 110 to which they are attached to be tightened round a wrist. In connection with the first part of the strap 120, a clamping mechanism 125 is attached which holds the two said parts of the strap 120 together when the end 122 of the second part of the strap 120 is passed through the clamping mechanism 125.

In an embodiment the strap 120 may be made of an elastic material which, when the strap 120 is tightened, will make for a good fit round a wrist.

In another embodiment the strap 120 may comprise a non-elastic sleeve with the clamping mechanism 125 at the end, where an elastic band passes through the sleeve and the clamping mechanism 125. By pulling the elastic band with one movement straight down relative to the bracelet illustrated in FIG. 3, the elastic band is shortened through the clamping mechanism 125, which will then draw the sleeve together so that if fits round the hand with a uniform pressure.

One of the main features of the present invention is that the control electronics in the bracelet 100 are activated or deactivated automatically depending on whether or not the bracelet is tightened round a wrist.

By having the strap 120 made of an elastic material, it will be possible to take off the bracelet 100 without having to loosen the clamping mechanism holding the two parts of the strap 120 together. This is one way of deactivating the bracelet 100.

Alternatively, in connection with the clamping mechanism 125 there may be a spring device 128 which causes the clamping mechanism 125 to also act as a release mechanism for the bracelet 100 when the spring device 128 is compressed. This action will also deactivate the bracelet 100.

The fact that the bracelet 100 is automatically deactivated when not fastened round a wrist is an important characteristic of the invention. A bracelet 100 which is not in use, i.e. not attached to a wrist, should not attract unnecessary attention from rescue personnel. As an extreme consequence this could give rise to dangerous situations.

In an embodiment of the bracelet 100, on the housing 110 is mounted an automatic release button 240 which when activated has two different functions depending on whether the bracelet 100 is activated or not, where one function is to conduct a status test of the functions of the bracelet 100 when it is not activated, and where the other function is to start transmission of warning sound and light when the bracelet 100 is activated, i.e. tightened round a wrist, and where the functions are controlled by the said control electronics. In the latter case the function of the motion sensor is disregarded.

The bracelet 100 may comprise additional means for measuring different status parameters for the person wearing it. The status parameters may include pulse, temperature and blood pressure.

The bracelet 100 may further comprise a radio transmitter for transmitting a signal which can be used for direction finding, as well as various measured status parameters of the person wearing it.

The areas of application of a bracelet 100 according to the present invention are many, but it is considered to be particularly well suited for use during escape from fire at hotels where the users cannot be expected to have become particularly well acquainted with escape equipment. The only thing the user has to do is to place the bracelet round his (her) wrist and draw it tight.

Offshore installations and ships are also considered to be areas for which the invention is particularly well suited.

The drawings with related description should be regarded as illustrating embodiments, and the invention should not be considered to be limited to these, but should cover all the embodiments defined in the attached set of claims.

The invention claimed is:

1. A bracelet (100) for use on a wrist during escape in the event of fire, comprising a housing (110) attached to a strap (120) comprising a first and second part which can be moved relative to each other, thereby enabling the circumference of the strap (120) to be adjusted, and where the housing (110) is pressed against the wrist when the strap (120) is tightened, and where the housing (110) comprises a power supply and control electronics for controlling a sound and light signal warning, and where the bracelet (100) further comprises a device in the housing (110) connected to the control electronics for detecting a status as to whether the bracelet (100) is in motion or not, and means for controlling transmission of sound and light on the basis of the detected status, and where the bracelet (100) is characterised in that it further comprises an attachment mechanism for the strap (120) to the housing (110) comprising means for activating the control electronics in the bracelet (100) when the strap (120) is tightened round the wrist, as well as for deactivating the control electronics in the bracelet (100) when the strap (120) is slackened off again, and where this is made possible by the said attachment mechanism for the strap (120) comprising a first and second attachment mechanism on opposite sides of the housing (110), where one end of the strap (120) is fastened in the said first attachment mechanism by means of a fastening device (215), and where the other end of the strap (120) is attached to a holding device (210) which is attached to an upper end of a spring mechanism (200) located in a pocket (205) in the housing (110), where the lower end of the spring mechanism (200) is fastened to the housing (110), while the upper end can move freely in a linear movement in the pocket (205), and where the spring mechanism (200) is compressed when the strap (120) is tightened round the wrist, with the result that contact is established in a switch (220) located in the housing (110), and where the switch (220) is connected to the said control electronics, thereby causing the bracelet (100) to be activated.

2. A bracelet (100) according to claim 1, characterised in that the holding device (210) comprises a magnet (225) which has the effect of establishing contact in the said switch (220) when the spring mechanism (200) is compressed.

3. A bracelet (100) according to claim 1, where in connection with the said first part of the strap (120) there is attached a clamping mechanism (125) which holds the two said parts of the strap (120) together when the end (122) of the second part of the strap (120) is passed through the clamping mechanism (125), and where the clamping mechanism (125) is characterised in that if further comprises a spring device (128) which causes the clamping mechanism (125) to also act as a release mechanism for the bracelet (100) when the spring device (128) is compressed.

4. A bracelet (100) according to claim 1, characterised in that on the housing (110) there is mounted an automatic release button (240) which when activated has two different functions depending on whether the bracelet (100) is activated or not, where one function is to conduct a status test of the functions of the bracelet (100) when it is not activated, and where the other function is to start transmission of warning sound and light when the bracelet (100) is activated, and where the functions are controlled by the said control electronics.

5. A bracelet (100) according to claim 1, characterised in that it further comprises a filter (160) which is attached to the strap (120).

6. A bracelet (100) according to claim 1, characterised in that it is furthermore covered with friction material on its inside in order to permit tightening of the bracelet (100) round the wrist with one movement.

7. A bracelet (100) according to claim 1, characterised in that it comprises a directional light (130), a strobe light (140) and a sound-generating device (150), where the directional light (130) is employed as a torch for lighting up the environment when the bracelet (100) is activated, and the strobe light (140) and the sound-generating device (150) indicate that the bracelet (100) has not been in motion for a predetermined period.

8. A bracelet (100) according to claim 1, characterised in that it further comprises means for measuring different status parameters for the person wearing the bracelet (100), where the status parameters include pulse, temperature and blood pressure.

9. A bracelet (100) according to claim 1 or 8, characterised in that it further comprises a radio transmitter for transmitting a signal which can be used for direction finding, as well as the said different measured status parameters for the person wearing the bracelet (100).

* * * * *